US012516487B2

(12) United States Patent
Thoopphonthap

(10) Patent No.: US 12,516,487 B2
(45) Date of Patent: Jan. 6, 2026

(54) PRECAST VERTICAL REINFORCEMENT CONCRETE CUBE RETAINING WALL AND MOLD

(71) Applicant: Phiproei Thoopphonthap, Nonthaburi (TH)

(72) Inventor: Phiproei Thoopphonthap, Nonthaburi (TH)

( * ) Notice: Subject to any disclaimer, the term of this patent is extended or adjusted under 35 U.S.C. 154(b) by 298 days.

(21) Appl. No.: 18/020,937

(22) PCT Filed: Sep. 28, 2021

(86) PCT No.: PCT/TH2021/000058

§ 371 (c)(1),
(2) Date: Feb. 12, 2023

(87) PCT Pub. No.: WO2023/287367

PCT Pub. Date: Jan. 19, 2023

(65) Prior Publication Data

US 2023/0287646 A1 Sep. 14, 2023

(30) Foreign Application Priority Data

Jul. 12, 2021 (TH) ..... 2103001968

(51) Int. Cl.
*E02D 29/02* (2006.01)
*E04B 2/36* (2006.01)

(52) U.S. Cl.
CPC ..... *E02D 29/025* (2013.01); *E02D 29/0266* (2013.01)

(58) Field of Classification Search
CPC ..... E02D 29/025; E02D 29/0266
See application file for complete search history.

(56) References Cited

U.S. PATENT DOCUMENTS

2008/0085162 A1* 4/2008 Blundell ..... E02D 29/0266
405/284
2019/0100894 A1* 4/2019 Nicol ..... E02D 29/0266

FOREIGN PATENT DOCUMENTS

KR 200340941 Y1 * 2/2004
KR 200361082 Y1 * 9/2004
KR 200399797 Y1 * 11/2005
KR 20060069805 A * 6/2006
KR 20130022601 A * 3/2013
WO WO-2017208010 A1 * 12/2017 ..... E02B 3/14

* cited by examiner

*Primary Examiner* — Amber R Anderson
*Assistant Examiner* — Stacy N Lawson
(74) *Attorney, Agent, or Firm* — Rivka Friedman

(57) ABSTRACT

A precast vertical reinforcement concrete cube retaining wall having blocks of precast concrete used as earth and water retaining walls, with vertical steel reinforcement and water-proofing features. It provides an alternative to substitute traditional cast-in-place concrete walls. The wall allows for rapid installation without scaffolding and formwork, reduces construction materials, takes less time and labor, and greatly reduces the cost of wall construction. After installation of the wall in one row, concrete grout is poured in each joint for homogeneous connection, similar to the cast-in-place wall installation. After completing the top row, vertical steel bars are inserted in each hole, connected with starter foundation bars, and filled with the concrete grout.

1 Claim, 15 Drawing Sheets

PRECAST VERTICAL REINFORCEMENT CONCRETE CUBE RETAINING WALL AND MOLD

FIELD OF THE INVENTION

The present invention pertains generally to retaining walls, and specifically the invention relates to a precast vertical reinforcement concrete cube used as an earth and water retaining wall.

BACKGROUND OF THE INVENTION

The construction of reinforced concrete retaining walls still use traditional cast-in-place methods, including formwork, scaffolding, and other materials, causing significant material waste.

It takes a long time to construct the wall, including the time for concrete curing and hardening. It requires significant labor, and a substantial construction budget.

The main purpose of this invention is to modify the product form and the installation method to provide an product alternative that reduces construction material consumption, lowers labor costs, reduces construction time, and saves on construction budgets. However, the benefits of the disclosed precast vertical reinforcement concrete cube retaining wall are the same, providing similar quality and performance as a cast-in-place type of concrete wall.

BRIEF DESCRIPTION OF THE DRAWINGS

In the following detailed description, reference will be made to drawings comprised of the following figures.

DISCLOSURE OF THE INVENTION

Figure 1:
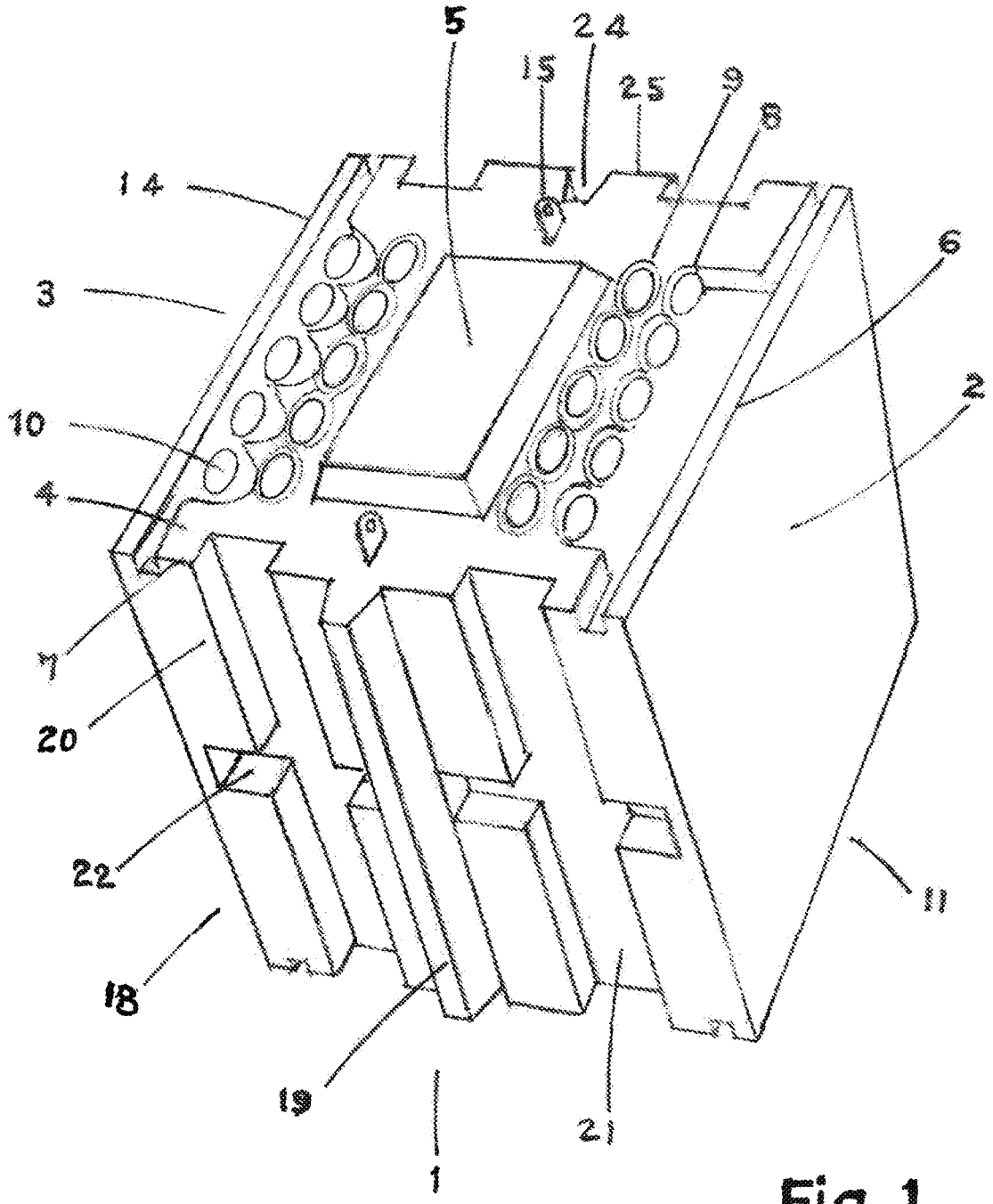
FIG. 1 is a perspective view of a precast vertical reinforcement concrete cube retaining wall.

FIG. 1, FIG. 2, FIG. 3 and FIG. 4, show a precast vertical reinforcement concrete cube retaining wall 1, which is the an embodiment of a concrete cube, having three dimensional space and solid shape, comprised of six square faces of a cube having equal length, breadth, and height. The six square faces of the wall 1 include a top front face 2, a rear face 3, a top face 4, a bottom face 11, a left side face 18, and a right side face 23. The front face 2 and rear face 3 of the wall 1 are smooth surfaces. The top face 4 contains a rectangular male interlocking 5, length thereof is parallel to and not more than half of a front upper edge 6. The breadth of the rectangular male interlocking 5 is parallel to and not less than twenty-five percent of a left upper edge 7. There are two rows parallel to the front upper edge 6: a first row 8 and a second row 9. The wall 1 has a plurality of round holes 10 placed vertically in rows 8 from the top face 4 to the bottom face 11. The number of round holes 10 in a row is at least five holes, and the diameter of each hole 10 does not exceed ten percent of the front upper edge 6. Each round hole of the second row 9 has a counterbore 12 at the same center. The diameter of the counterbore 12 is not less than fourteen percent and the depth thereof is not less than five percent of the front upper edge 6.

Figure 2:
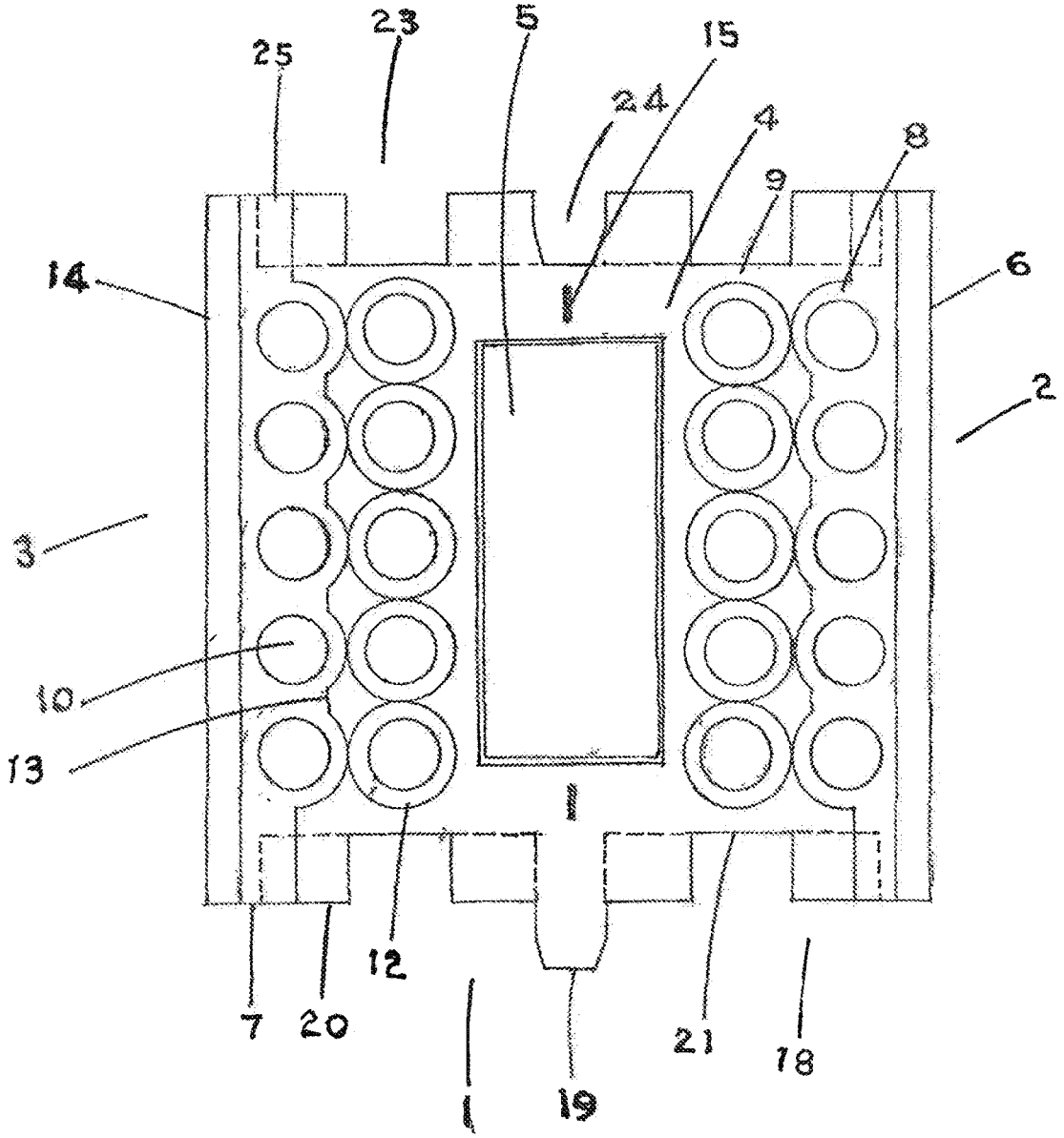
FIG. 2 is a plan view of the precast vertical reinforcement concrete cube retaining wall.
Figure 3:
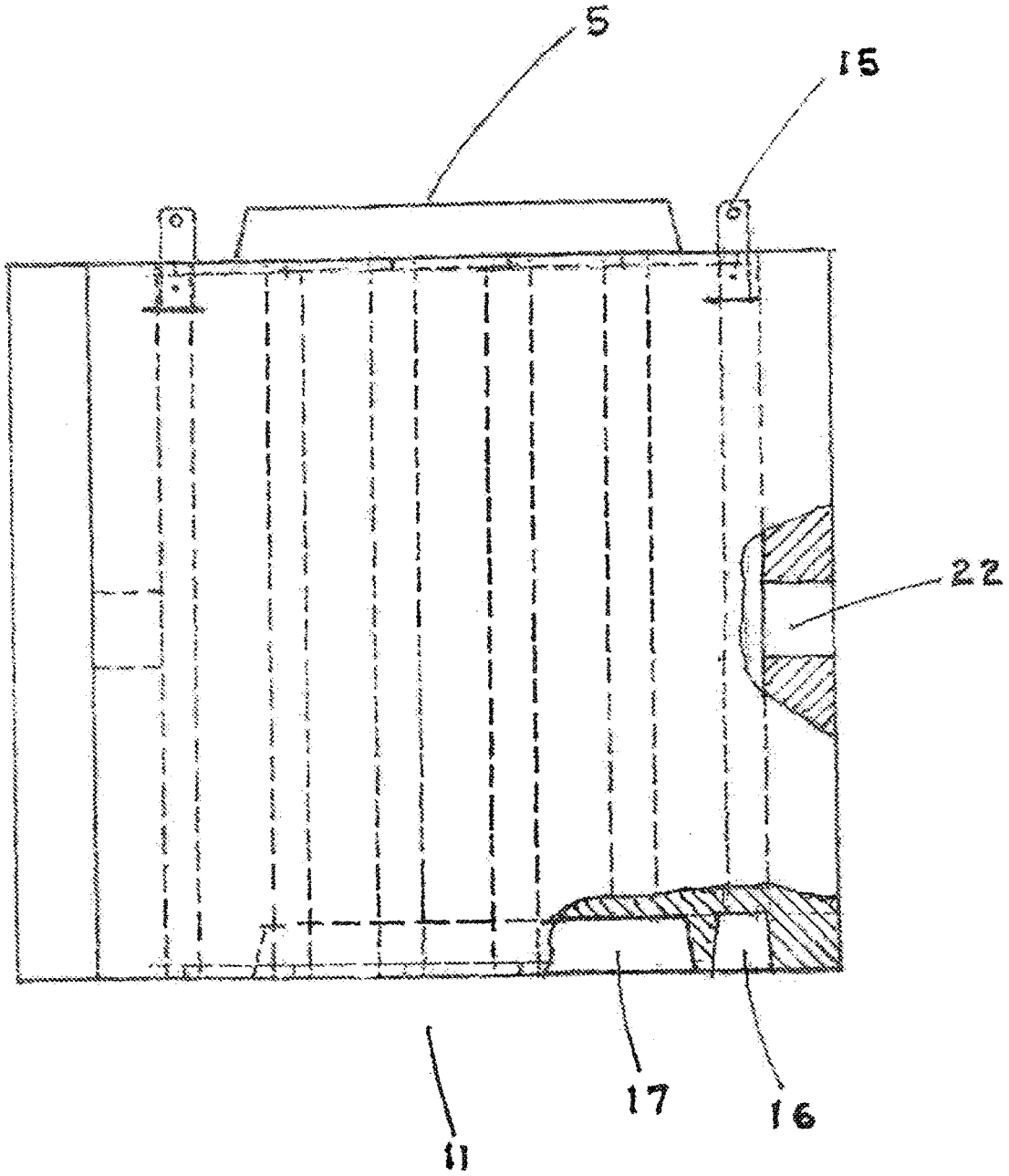
FIG. 3 is a front view of the precast vertical reinforcement concrete cube retaining wall
Figure 4:
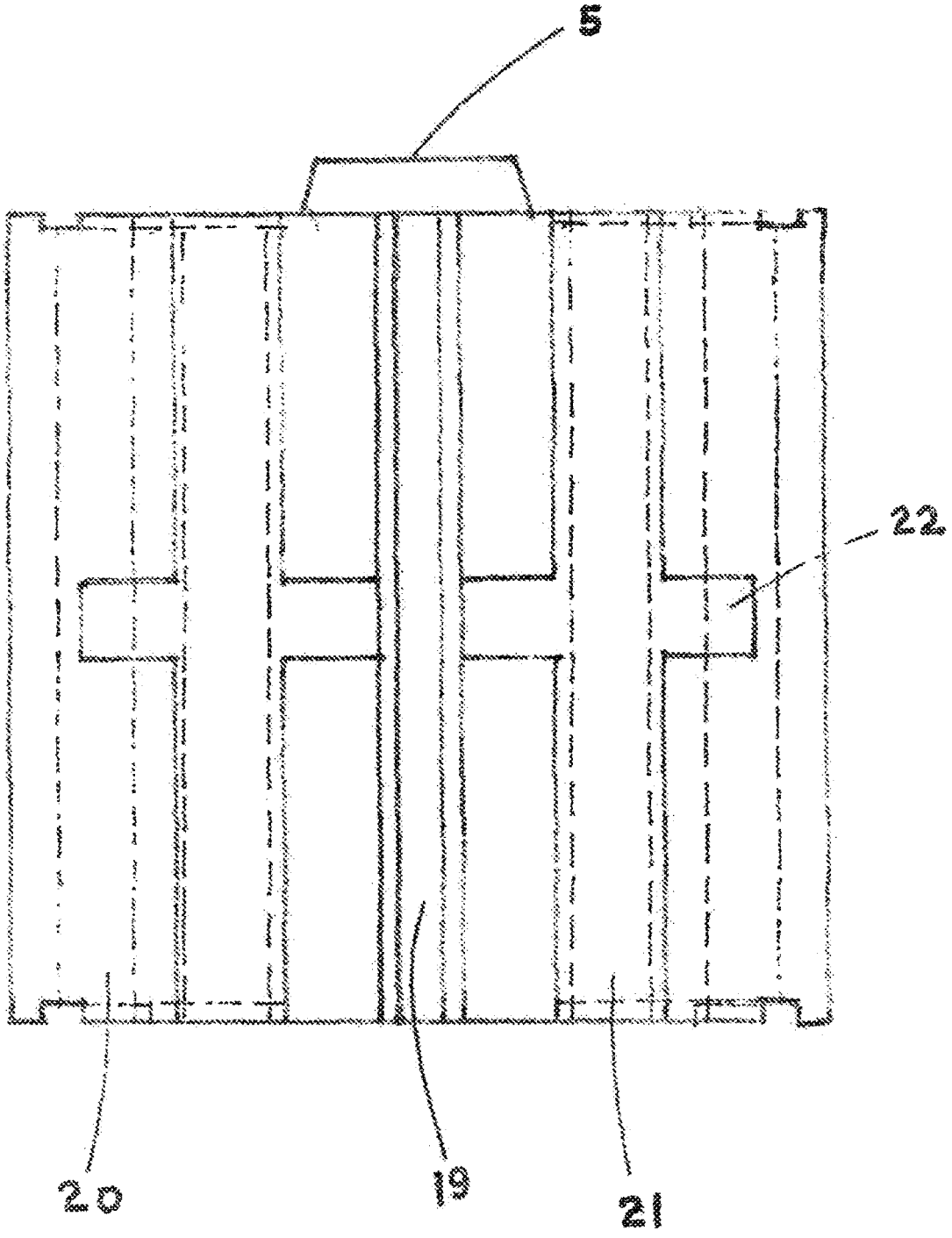
FIG. 4 is a left side view of the precast vertical reinforcement concrete cube retaining wall.
Figure 5:
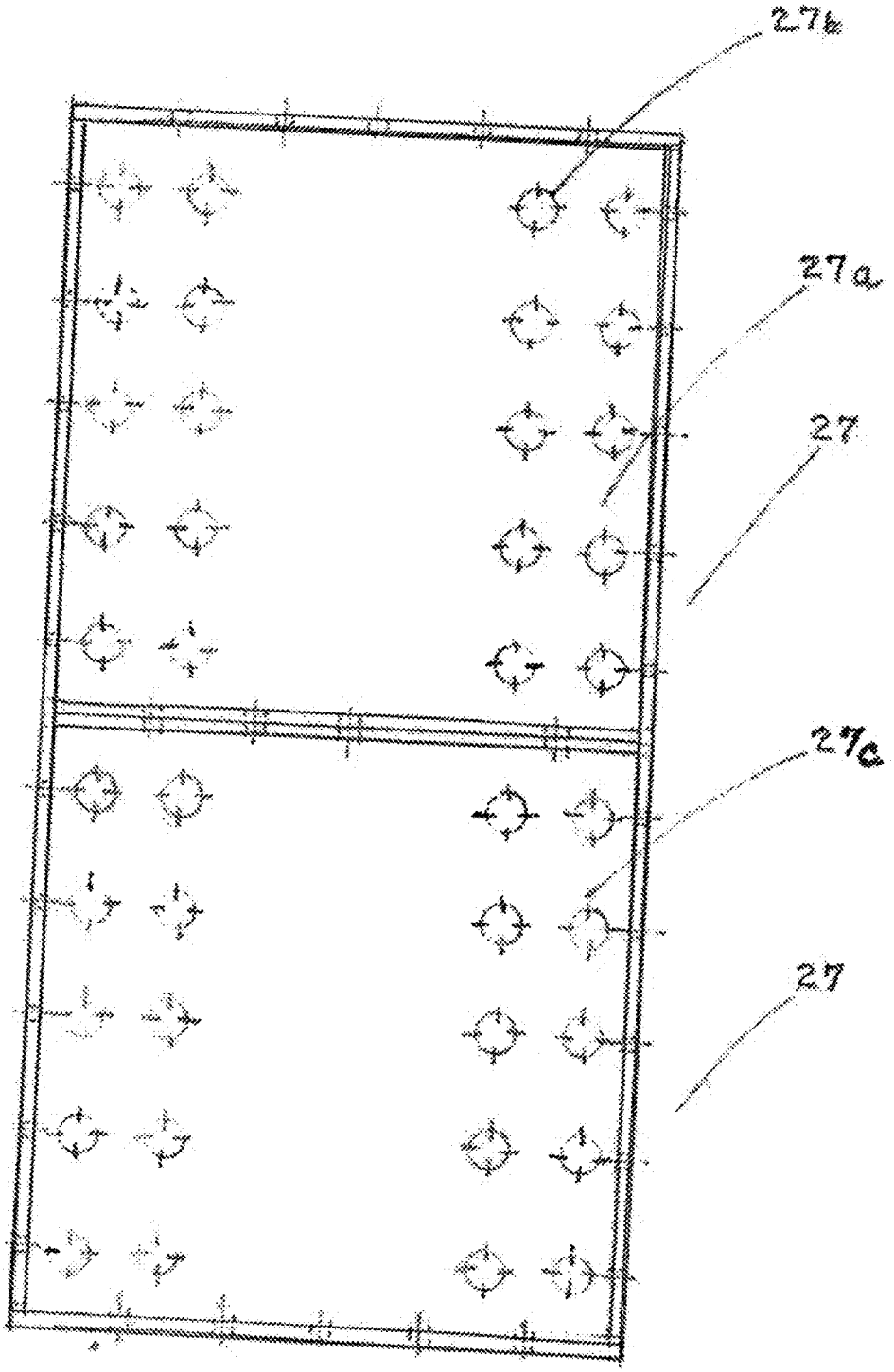
FIG. 5 is a cross-sectional view of first row blocks for precast vertical reinforcement concrete cube retaining wall installed on foundation.
Figure 6:
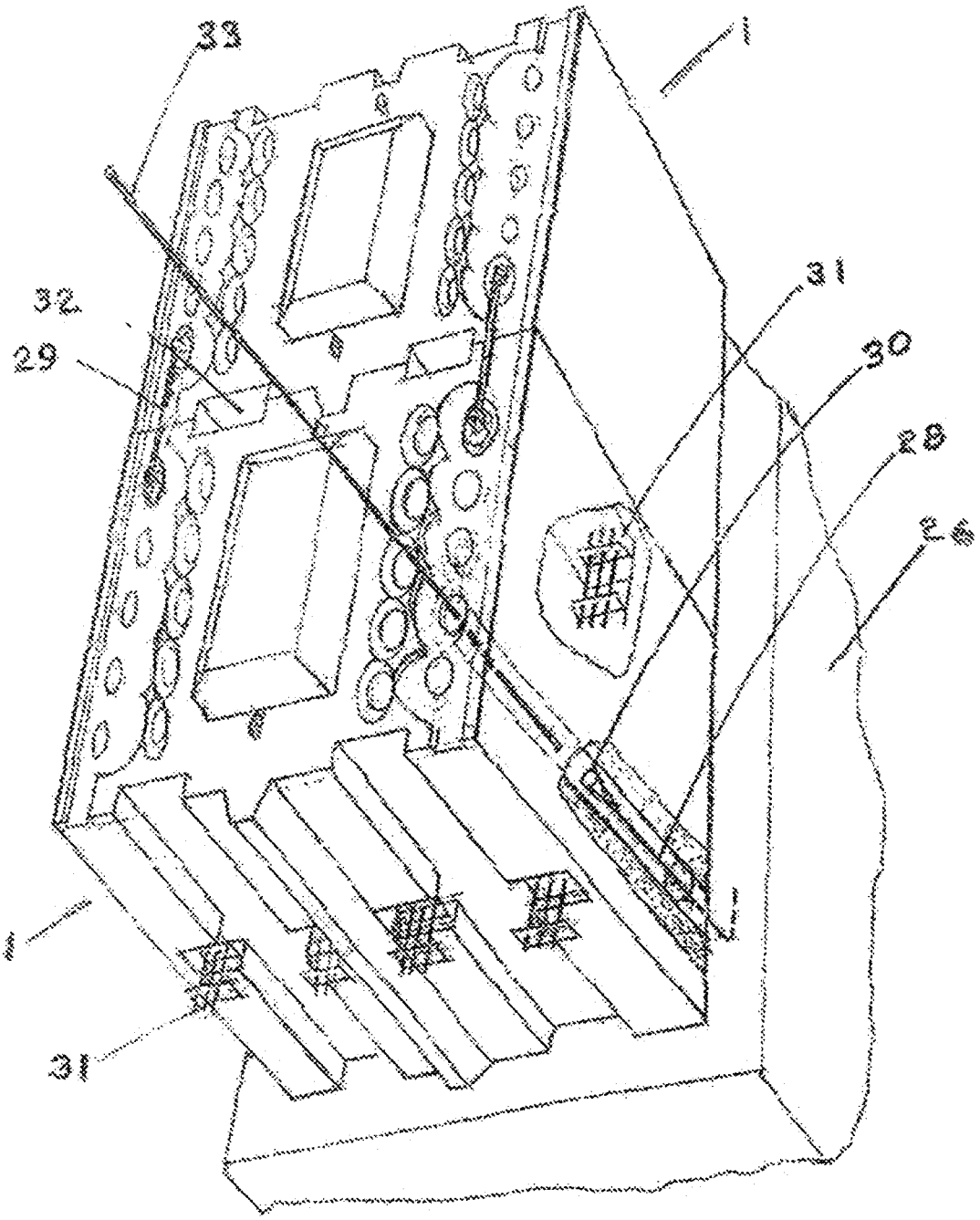
FIG. 6 is a cross-sectional view of top row blocks for the precast vertical reinforcement concrete cube retaining wall.
Figure 7:
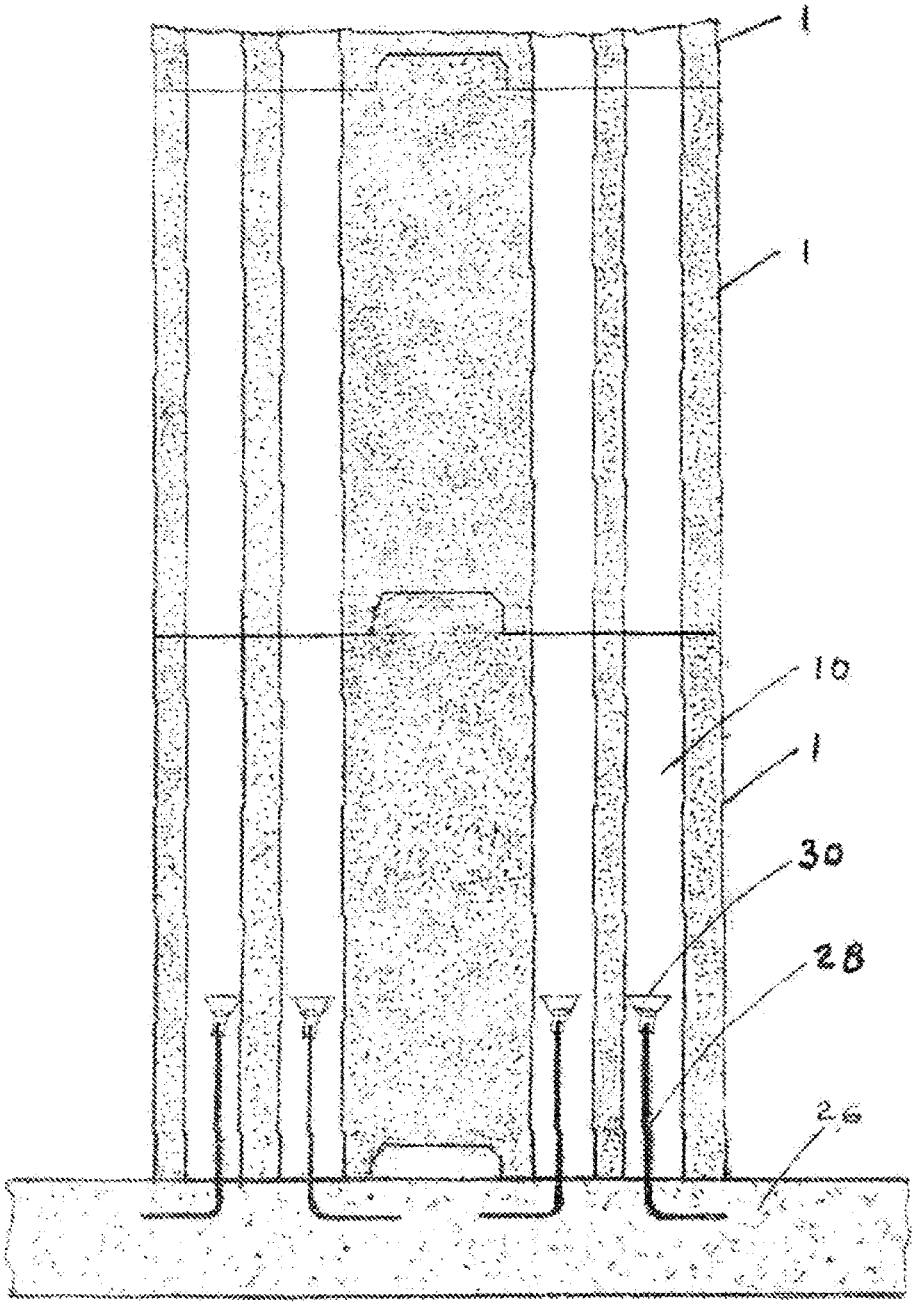
FIG. 7 is a perspective view of the precast vertical reinforcement concrete cube retaining wall showing the installation on the foundation.
Figure 8:
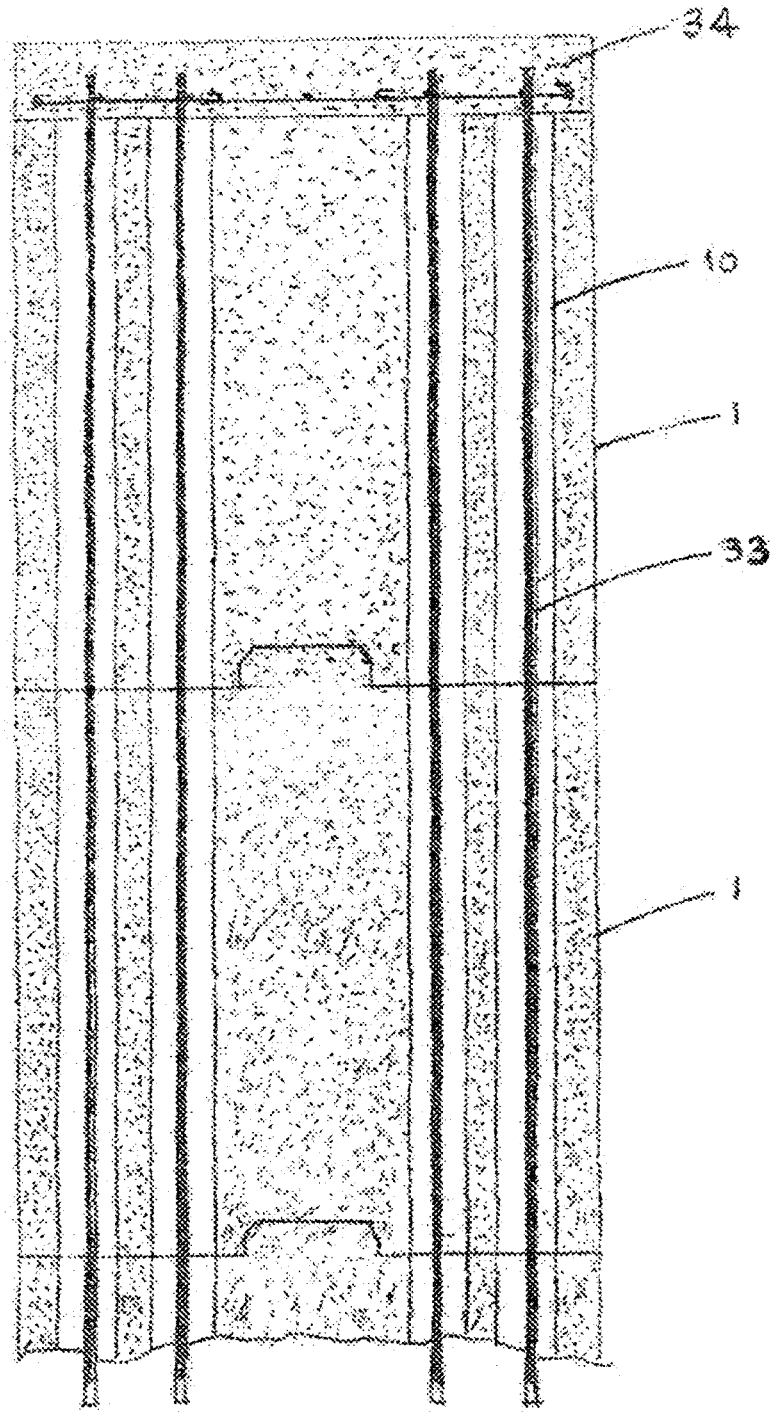
FIG. 8 is a plan view of a starter bar locator template on the top of the steel-reinforced foundation for the precast vertical reinforcement concrete cube retaining wall.
Figure 9:
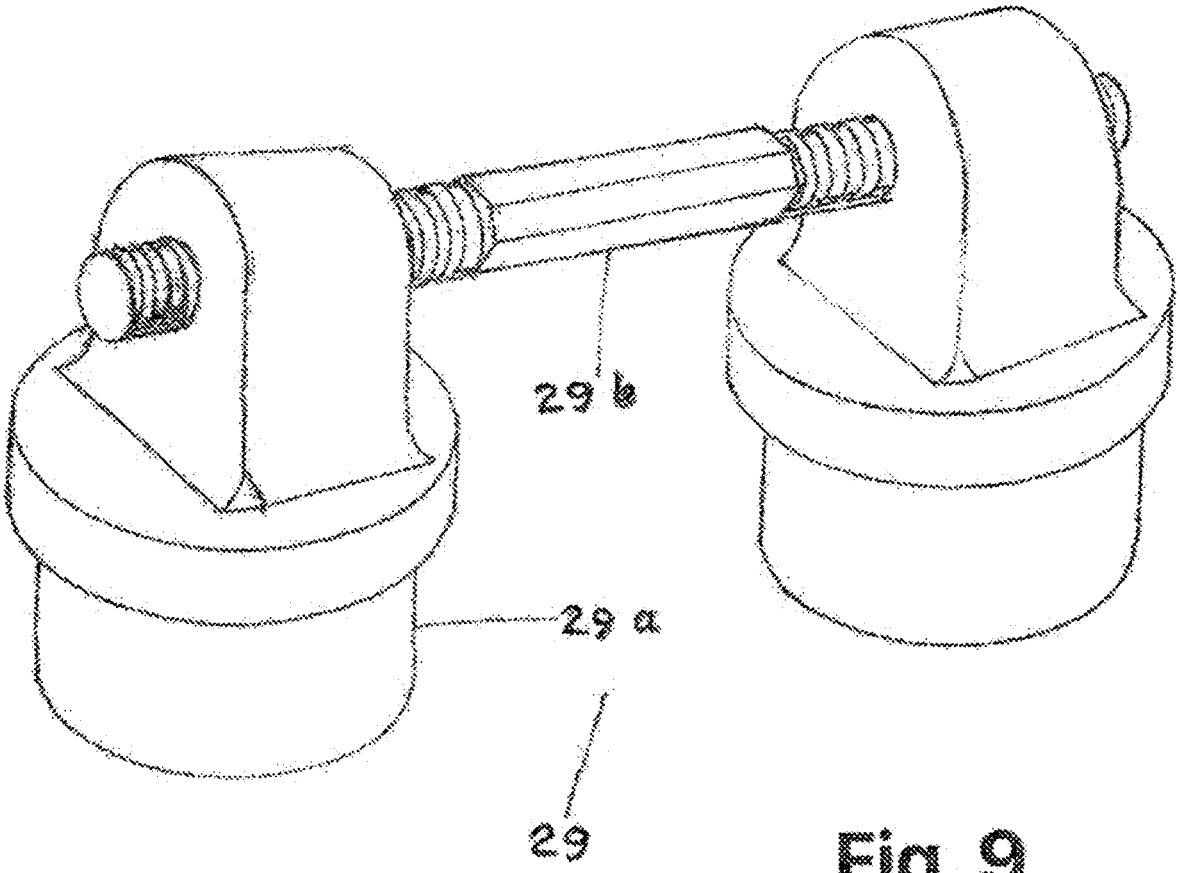
FIG. 9 is a perspective view of mechanical couplers with cones connected with the starter bars of the foundation for the precast vertical reinforcement concrete cube retaining wall.
Figure 10:
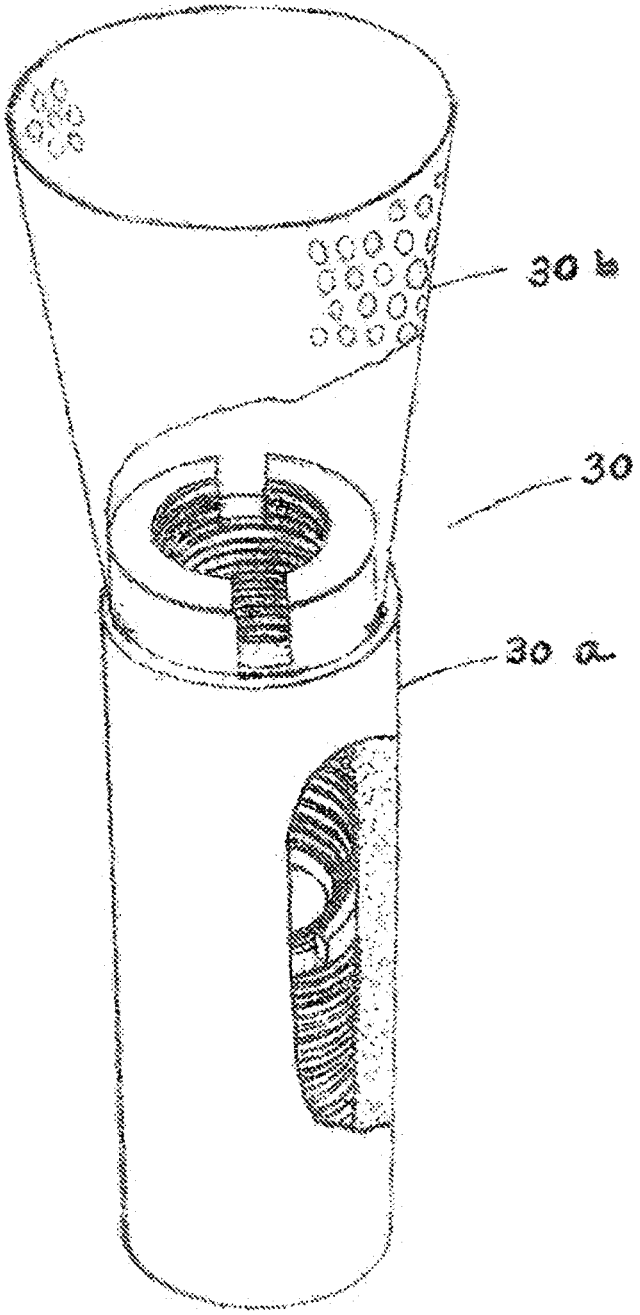
FIG. 10 is a perspective view of vertical shear rods laid on the base of hollow cubes connected between each precast vertical reinforcement concrete cube retaining wall.
Figure 11:
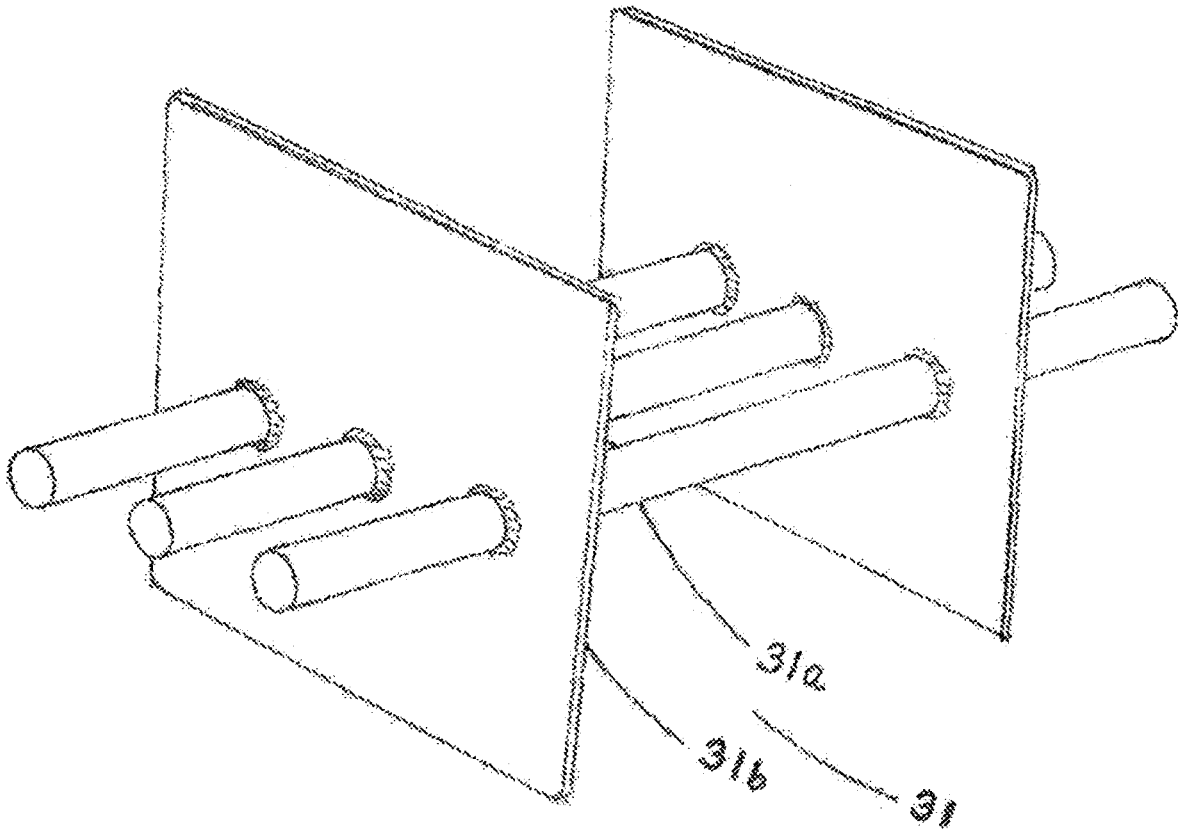
FIG. 11 is a perspective view of an adjuster kit for adjusting precast vertical reinforcement concrete cube retaining walls.

In the first row 8, the center of each hole 10 has an irregular circumference of the counterbore 12 and a straight line 13, with a depth equal to that of the second row 9 as shown in FIG. 2. On the opposite side, there are two rows parallel to the rear upper edge 14, and the number of holes and their positions are the same as on the front upper edge 6. At half of the left upper edge 7, and parallel to the front upper edge 6, a pair of lifting plates 15 is provided. The center line of the plates 15 is parallel to the front upper edge 6, and their position is at half of the left upper edge 7 between the rectangular male interlocking 5.

On the bottom face 11, a pair of covers 16 is provided for receiving the lifting plates 15. The pair of covers 16 is located on the bottom face 11 at the same center in the opposite direction as of the top face 4 having the lifting plates 15 and a rectangular female interlocking 17. The sizes and positions are the same as the rectangular male interlocking 5, wherein the rectangular female interlocking 17 is configured to receive the rectangular male interlocking 5, thereby allowing both the rectangular male 5 and female 17 interlockings to fit together. The bottom face 11 also comprises holes 10 and other features same as the front face 4.

The left side face 18 has a vertical male interlocking 19, position thereof is at half of the left upper edge 7, and the breadth is not less than twelve percent of the left upper edge 7 with a protruding taper tip, whose length is the same as the breadth. The height of the vertical male interlocking 19 extends from the top face 4 to the bottom face four 11. There are smooth surfaces 20, positions thereof are on the left and right sides of the vertical male interlocking 19, and both are close to the left and right edges. The breadth and height of the smooth surfaces 20 are equal to the vertical male interlocking 19. The spaces between the smooth surfaces are two grooves 21 positioned between the left and right smooth surfaces 20. The breadth of them not less than sixteen percent of the left upper edge 7. The height of the smooth surfaces 20 and grooves 21 is equal to the height of the vertical male interlocking 19 and the depth of the grooves 21 is equal to the breadth of the smooth surfaces 20. At half of the height on the left side face 18 and at four sides of the four smooth surfaces 20, four hollow cubes 22 are provided. The hollow cubes 22 are vacant and their length, breadth, and height are equal to the breadth of the smooth surfaces 20.

On the opposite side of the left side face 18, a vertical female interlocking 24 is provided at half of a right side upper edge 25 on the right side face 23. The sizes, shapes, position, and height of the vertical female interlocking 24 are all the same as the vertical male interlocking 19. The vertical female interlocking 24 is arranged to snugly fit with the vertical male interlocking 19. The hollow cubes 22 of the right side face 23 have same positions, sizes, and number same as the left side face 18.

As shown in FIG. 5, FIG. 6, FIG. 7, FIG. 8, FIG. 9, FIG. 10, and FIG. 11, the following steps describes the installation process for the precast vertical reinforcement concrete cube retaining wall 1:

First step: The installation process begins by constructing a reinforced concrete foundation 26 to support the precast vertical reinforcement concrete cube retaining wall 1 by placing a plurality of starter bar locator templates 27, consisting of a square steel plate 27*a* welded with a round tube 27*b* and adjust screws 27*e*. These starter bar locator templates 27 are locked on the top of the steel reinforced rods of the foundation 26, and the starter bars 28 are inserted into the round tubes connected to the steel reinforced rods of the foundation 26. Each upper end of the starter bars 28 is threaded.

The first precast vertical reinforcement concrete cube retaining wall 1 is lifted to lay it on the reinforced concrete foundation 26, controlling each round hole 10 to match with each starter bar 28 as mentioned above. Then lift the second precast vertical reinforcement concrete cube retaining wall 1 and lay it on the reinforced concrete foundation 26, thereby placing the vertical female interlocking 24 close to the vertical male interlocking 19 or the vertical male interlocking 19 close to vertical female interlocking 24. Further, a pair of blocks is tightened using the adjuster kit 29 for the precast vertical reinforcement concrete cube, by inserting a pair of mounting-cores 29*a* into the round holes 10 of both blocks on both sides, front and rear sides respectively, and turning the screw driver 29*b* to adjust and hold them in place. Next, mechanical couplers are connected with cones 30, which consist of mechanical couplers 30*a* having upper and lower internal threads. The upper end has a slot for assembling the mechanical coupler, connecting it with the threaded end of the starter bars 28 in each round hole 10 tightly, and has a perforated sheet metal cone 30*b* welded to the upper mechanical coupler.

Further, four vertical shear rods 31 are installed into the two rectangle openings 32, laying them on the base at both sides, left and right, of the hollow cubes at two places. The vertical shear rods 31 consist of steel bars 31*a*, with no fewer than two pieces welded with double steel plates 31*b*. Continue this process until the end of the first row on the foundation 26, then pour concrete grout from the rectangular openings to each left and right hollow cube and continue filling the rectangular openings until full, thereby completing the first step.

Second step: Install the upper and second row by lifting the first precast vertical reinforcement concrete cube retaining wall 1 down to place it on the lower block, where the rectangle female interlocking 17 of the bottom face 11 is placed on the lower rectangular male interlocking 5 of the top face 4 firmly. From this, the first block with the vertical male interlocking 19 is installed to the left direction, then the second precast vertical reinforcement concrete cube retaining wall 1 is lifted down to place it on the second block at the lower part of the first row. The vertical female interlocking 24 is placed close to the vertical male interlocking 19 and the rectangular female interlocking 17 is placed on the rectangular male interlocking 5 firmly. A pair of blocks are adjusted to be closed as mentioned above. The vertical shear rods 31 are laid on the base of the hollow cubes of the rectangular openings 32 as mentioned above.

Third step: Continue installing each row of the wall 1 using this process until reaching the top row of the project. The aforementioned process is continued until the end of the wall is completed. Further, the vertical rebars 33 with lower threaded ends are placed into each round hole 10, thereby connecting them with the mechanical couplers with cones 30 at the bottom of round holes firmly. The cement grout is poured into each hole completely, preparing to construct a reinforced concrete slab 34 to be placed on the top of the wall. This completes the wall installation process.

Figure 12:
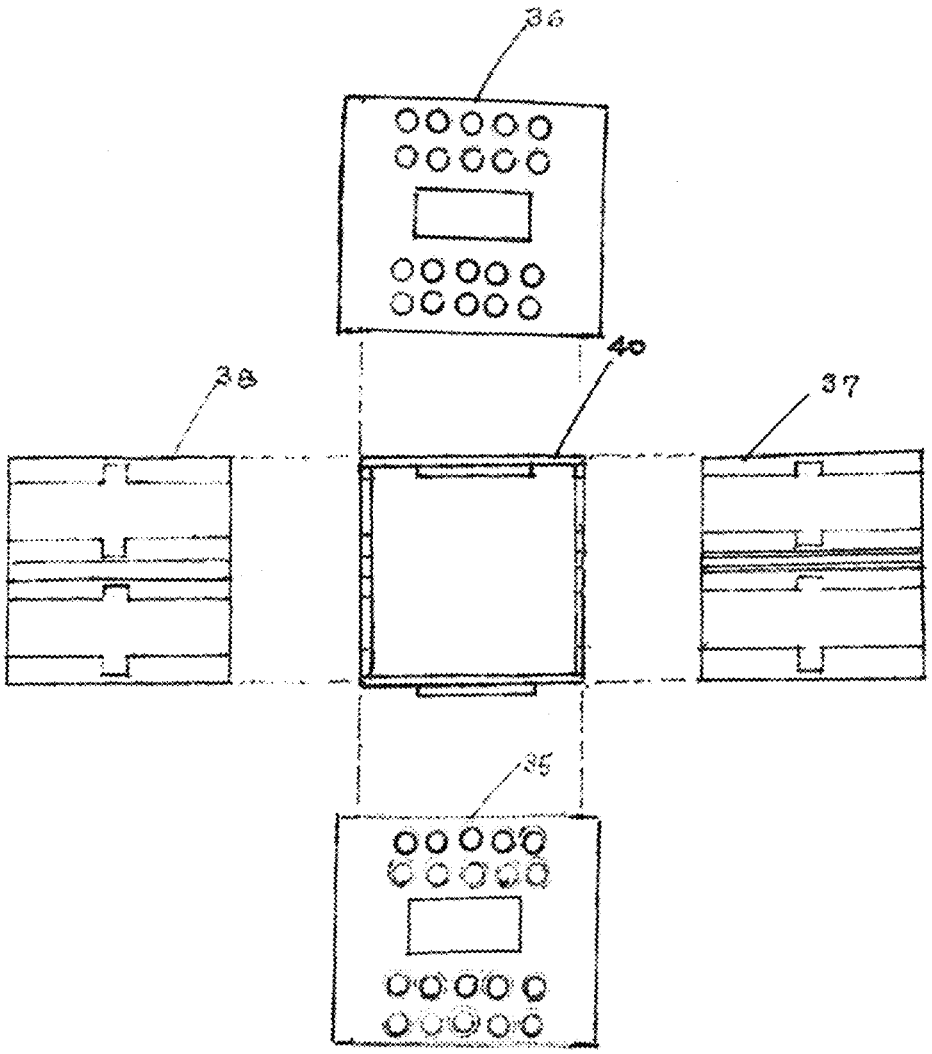
FIG. 12 is an exploded plan view of a mold assembly showing four vertical panels of the mold assembly for casting different concrete faces of the precast vertical reinforcement concrete cube retaining wall.

FIG. 12 shows an exploded plan view of a mold assembly 40 comprising four vertical molding panels, including a front panel 35, a rear panel 36, a right panel 37 and a left panel 38, provided for casting four vertical concrete faces of the precast vertical reinforcement concrete cube retaining wall 1

The four vertical mold panels 35, 36, 37, 38 of the mold assembly are provided to cast different parts of the wall 1, wherein the right panel 37 is a female mold for casting the left side face 18 of the wall 1 which has a vertical male interlocking 19, the left panel 38 is a male mold for casting the right side face 23 of the wall 1 which has a vertical female interlocking 24, and the front panel 35 and the rear panel 36 are used for casting the front face 4 and the bottom face 11 of the precast concrete cube wall 1, respectively.

Figure 13:
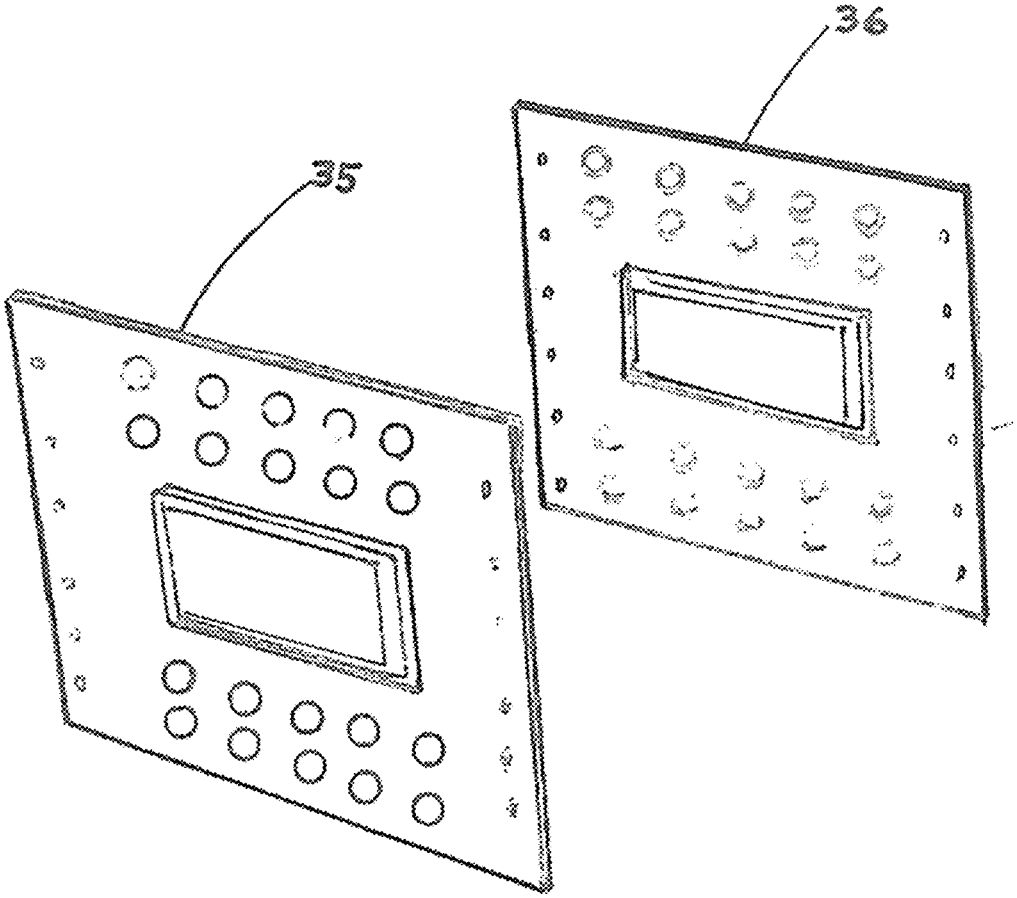
FIG. 13 is a perspective view of front and rear panels of the mold assembly for casting top and bottom concrete faces of the precast vertical reinforcement concrete cube retaining wall.

FIG. 13 shows a perspective view of the front panel 35 and the rear panel 36 of the mold assembly, provided for casting front face 4 and the bottom face 11 of the wall 1. Similarly, FIG. 14 shows a perspective view of the right panel 37 and the left mold panel 38, provided for casting the left side 18 and right side 23 faces of the wall 1.

Figure 14:
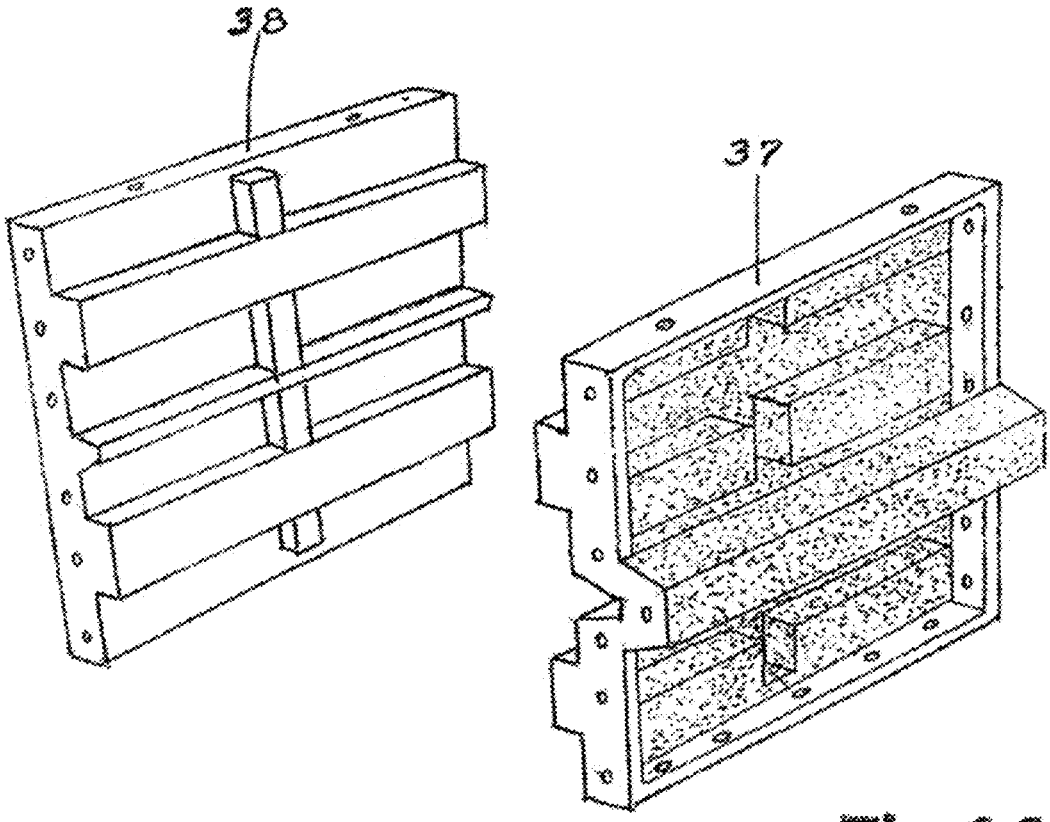
FIG. 14 is a perspective view of left and right panels of the mold assembly for casting left and right side concrete faces of the precast vertical reinforcement concrete cube retaining wall mold.

As shown in FIG. 14, the right panel 37 comprises different molding members to cast corresponding portions of the left side face wall 18, including the vertical male interlocking 19, smooth surfaces 20, four hollow cubes 22, two grooves 21 of the left side face 18 of the wall 1. Similarly, the configuration of the left panel 38 is provided with different molding members corresponding to the right panel 37 except the male mold member to cast corresponding portions of the right side face 23 of the wall 1. Unlike the female interlocking molding member of the right panel 37, the male mold member of the left panel 38 enables casting of the vertical female interlocking 24 on the right side face 23 of the wall 1.

Figure 15:
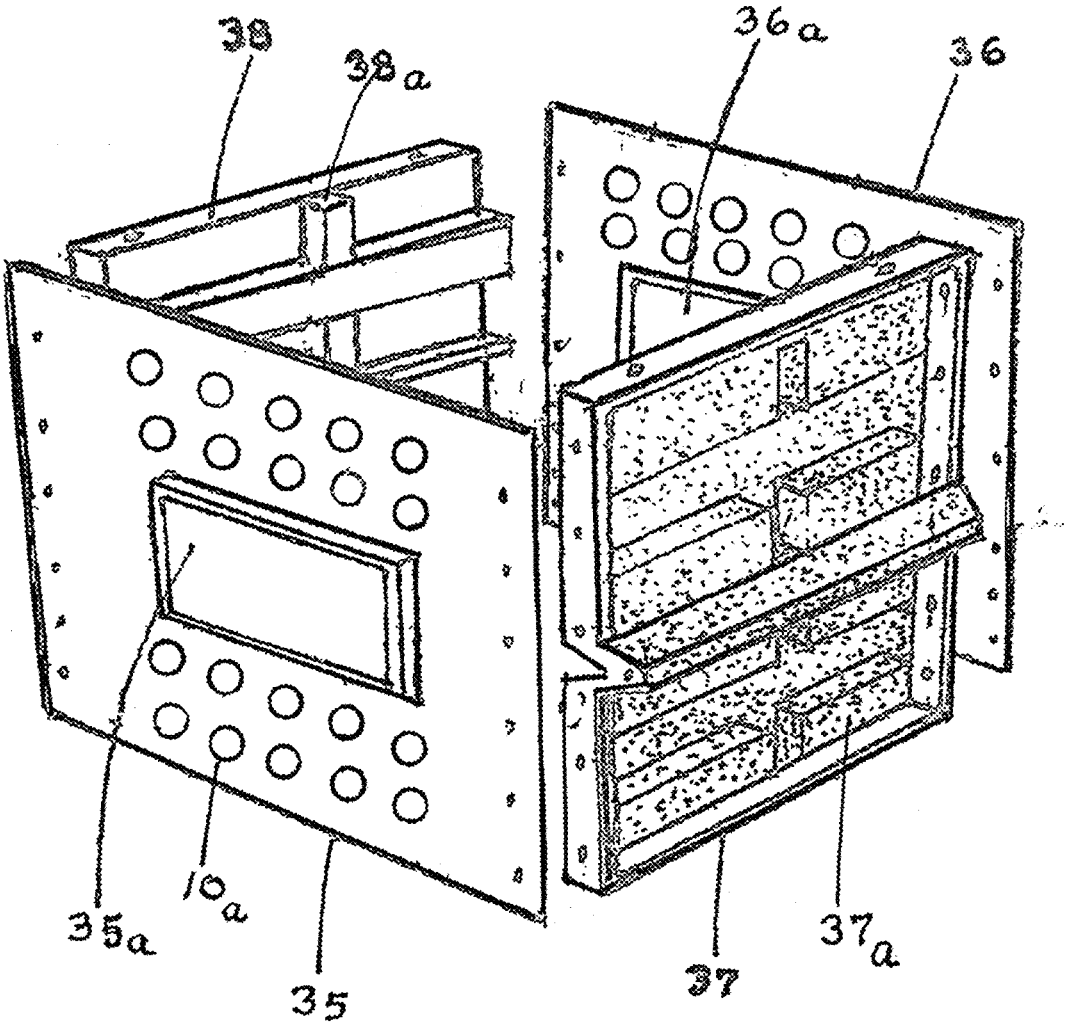
FIG. 15 is a perspective view of the mold assembly showing four panels for casting the precast vertical reinforcement concrete cube retaining wall.

FIG. 15 is a perspective view of the mold assembly 40 showing all four vertical mold panels 35, 36, 37 and 38, provided for casting the four corresponding vertical concrete faces 4, 11, 18 and 23 of the precast vertical reinforcement concrete cube retaining wall 1. The mold assembly 40 consists the four panels assembled into a cube: the rectangular front panel 35 is bolted to the square right face panel 37, followed by the square left face panel 38, and finally the rectangular rear panel 36, which is bolted to both side panels 37 and 38.

The front panel 35 of the mold assembly includes a member 10*a* to cast at least ten round holes 10 and a female interlocking mold member 35*a* to cast the male interlocking 5 on the top face 4 of the wall 1. Further, the rear panel 36 includes a member 10*a* similar to the member 10*a* of the front panel 35, except the male interlocking mold member 36*a* which is provided to cast the female interlocking 17 on the bottom face 11 of the wall 1. The right 37 and left 38 panels include mold members 37*a* and 38*a* to cast different sections of the left side 18 and right side 23 faces of the wall 1, respectively. For instance, as shown in FIG. 15, the mold member 37*a* of the right panel 37 of the mold assembly is provided to cast the corresponding sections including the vertical male interlocking 19, smooth surfaces 20, four hollow cubes 22, two grooves 21 on the left side face 18 of the wall 1. Similarly, a mold member 38*a* of the left panel 38 of the mold assembly is provided to cast the corresponding sections including the vertical female interlocking 24, smooth surfaces 20, four hollow cubes 22, two grooves 21 on the right side face 23 of the wall 1.

The invention claimed is:

1. A precast vertical reinforcement concrete cube retaining wall, the wall comprising:

a concrete cube having a three-dimensional, solid shape, comprising six square faces including a front face, a rear face, a top face, a bottom face, a left side face, and a right side face, wherein the length, breadth, and height of the six faces are the same;

wherein the front face and rear face have smooth surfaces;

wherein the top face comprises a rectangular male interlocking feature, and the length of the rectangular male interlocking feature is parallel to and not more than half of the length of a front upper edge, the breadth is parallel to and not less than twenty-five percent of the length of a left side upper edge, and the thickness not less than eight percent of the length of the front upper edge;

wherein the bottom face has a rectangular female interlocking feature, wherein the size, shape, and position of the rectangular female interlocking feature are the same as the rectangular male interlocking feature on the top face;

wherein the top face comprises at least two rows parallel to the front upper edge, a first row, and a second row, each row having round holes placed vertically from the top face to the bottom face, wherein the number of round holes in each row is not less than five, and the diameter of each hole is not exceeding ten percent of the length of the front upper edge;

wherein each round hole of the second row has a counterbore at the same center, and the diameter of the counterbore is not less than fourteen percent of the length of the front upper edge and the depth is not less than eight percent of the length of the front upper edge;

wherein each round hole of the first row has a counterbore with an irregular circumference that is partially round and partially a straight line, and the depth is the same as that of the counterbore of the second row;

wherein the top face comprises two rows parallel to a rear upper edge, wherein the holes in the rows parallel to the rear upper edge are symmetrical to the holes in the rows parallel to the front upper edge;

wherein at a middle of the left side upper edge and a right side upper edge, and parallel to the front upper edge, the top face has a pair of lifting plates;

wherein on the bottom face a pair of covers are positioned are vertically aligned with the lifting plates on the top face;

wherein the left side face comprises a vertical male interlocking feature, and the position of the vertical male interlocking feature is at a middle of the left side upper edge, the breadth not less than twelve percent of the length of the left side upper edge, with a protruding taper tip, having length a double the breadth, and a height extending from the top face to the bottom face;

wherein the left side face has smooth surfaces positioned on the left and right side of the vertical male interlocking feature, and the breadth and height of the smooth surfaces are equal to the vertical male interlocking feature;

wherein the left side face comprises a plurality of grooves, positioned between the left and right smooth surfaces, wherein the breadth of the grooves is not less than sixteen percent of the length of the left side upper edge, the height is equal to the height of the vertical male interlocking feature, and the depth is equal to the breadth of the smooth surfaces;

wherein at half of the height of the left side face, and on both sides of the smooth surfaces, the left side face comprising four hollow cubes, wherein the length, breadth, and height of each hollow cube are equal to the breadth of the smooth surfaces;

wherein the four hollow cubes are on the left side face, positioned at the left and right of the smooth surfaces;

wherein the right side face comprises a vertical female interlocking feature, positioned at a middle of the right side upper edge, and the size, shape, and height of the vertical female interlocking feature are the same as the vertical male interlocking feature on the left side face;

wherein the vertical female interlocking feature is configured to fit on the vertical male interlocking feature; and wherein the right side face comprises hollow cubes that have positions, sizes, and quantities that are the same as those on the left side face.

* * * * *